United States Patent [19]

Solomon

[11] Patent Number: 4,574,708

[45] Date of Patent: Mar. 11, 1986

[54] DAMPING MECHANISM FOR A TRUCK ASSEMBLY

[75] Inventor: James E. Solomon, Lithopolis, Ohio

[73] Assignee: Buckeye International, Inc., Columbus, Ohio

[21] Appl. No.: 567,777

[22] Filed: Jan. 3, 1984

[51] Int. Cl.[4] ..... B61F 5/04

[52] U.S. Cl. ..... 105/193; 105/206 R; 105/207

[58] Field of Search ..... 105/185, 193, 197 R, 105/200, 204, 206 R, 207

[56] References Cited

U.S. PATENT DOCUMENTS

| | | | |
|---|---|---|---|
| 1,712,908 | 5/1929 | Symington | 105/193 |
| 2,159,138 | 5/1939 | Duryea | 105/207 |
| 2,317,352 | 4/1943 | Bachman | 105/197 |
| 2,324,267 | 7/1943 | Oelkers | 105/197 |
| 2,352,595 | 7/1944 | Bachman | 105/197 |
| 2,352,693 | 7/1944 | Davidson | 105/206 R |
| 2,366,973 | 1/1945 | Light | 105/197 |
| 2,422,638 | 6/1947 | Tucker | 105/197 |
| 2,723,630 | 11/1955 | Settles | 105/206 R |
| 3,079,873 | 3/1963 | Tack et al. | 105/206 R |
| 3,254,613 | 6/1966 | Weber | 105/197 |
| 3,261,305 | 7/1966 | Shafer | 105/197 |
| 3,450,063 | 6/1969 | Shafer | 105/197 |
| 4,084,514 | 4/1978 | Bullock | 105/206 R |
| 4,244,298 | 1/1981 | Hawthorne et al. | 105/197 |

*Primary Examiner*—Louis J. Casaregola

*Attorney, Agent, or Firm*—Charles F. Pigott, Jr.

[57] ABSTRACT

A damping mechanism for a truck assembly employing a resiliently mounted wedge to cooperate with a bolster in a manner to prevent wear. The damping assembly is biased outwardly and a friction plate employed between the wedge and bolster, further reducing frictional contact with the side frame.

8 Claims, 7 Drawing Figures

FIG. 3
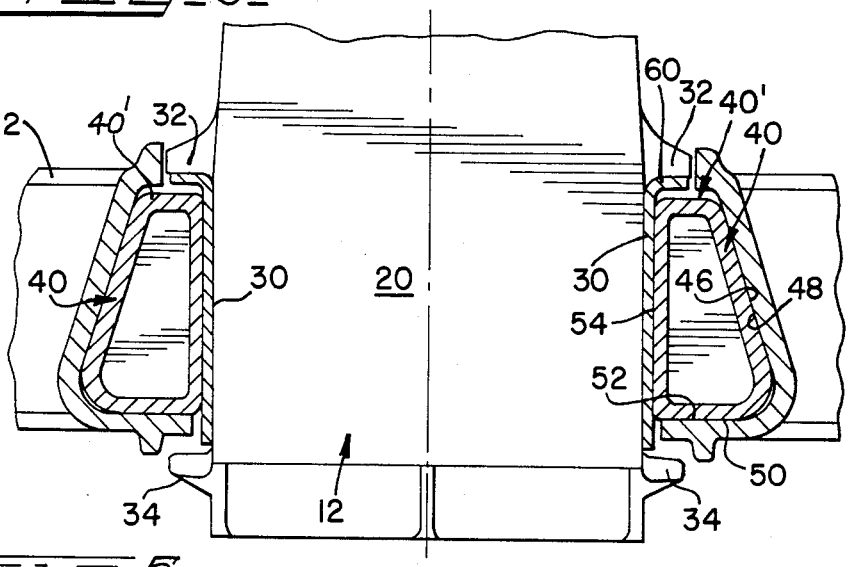
FIG. 5
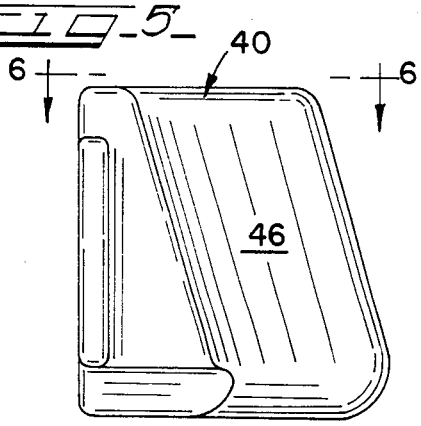
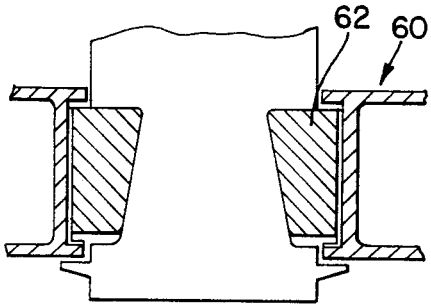
FIG. 7
FIG. 4
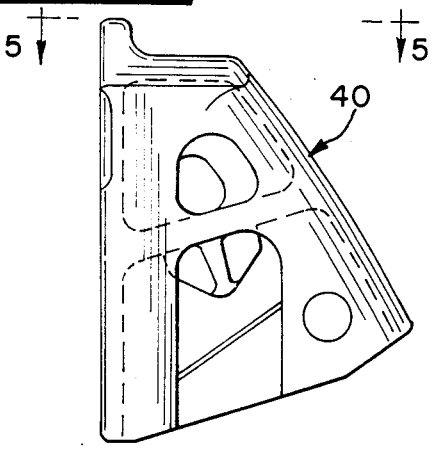
FIG. 6
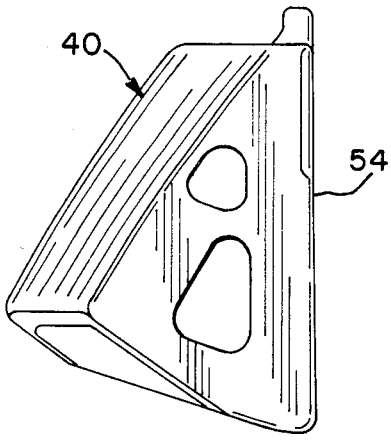

DAMPING MECHANISM FOR A TRUCK ASSEMBLY

BACKGROUND OF THE INVENTION

This invention relates to friction snubbed railway trucks and, in particular, to both lateral and vertical damping of what is commonly known as a three piece truck.

Geometrical constraints of past friction snubbed railway track designs of either constant or variable damping have limited the amount of damping. These geometrical constraints have further limited the amount of truck squaring moment between the main elements of the three piece truck.

Recent three piece truck designs using longer travel springs have aggravated an ever-existing wear problem between the main elements of the three piece truck. This sustained wear problem is caused by light car truck hunting, lack of lateral damping capability at loaded car, loaded car rocking, loaded car pitching and bouncing, or various combinations of these conditions.

The friction snubbing means of a conventional three piece truck is designed primarily to dampen the periodic oscillations of the truck bolster as it vibrates both vertically and horizontally on its supporting springs in respect to the two side frames during normal operation. The limit cycle of the vertical oscillations is the solid spring condition of the bolster support springs. This condition is not uncommon in underdamped trucks. The limit cycle of the lateral oscillations of the truck bolster is the contacting of the bolster gibs with the side frame columns. This condition appears normally at the contact of the bolster inner gibs with the inside surfaces of the side frame columns. Truck hunting and excessive vertical car bouncing promote rapid wear of the relatively soft cast steel parts at this element interface.

In addition, known three piece truck designs utilize snubbing structures that possess lesser dimensions in the horizontal direction than in the vertical direction. These narrower dimensions of past snubbing means do not give adequate squaring moment capabilities, an adverse problem especially apparent on variable damped trucks.

Due to geometrical constraints previously mentioned, some past designs of constant damped trucks do not have the elements of the damping mechanism in full friction face contact at all positions of bolster travel. Thus, the unit pressure between the friction elements is variable and at some conditions of bolster travel, the resulting higher unit pressure promotes more rapid wear of the friction elements.

SUMMARY OF THE INVENTION

It is, therefore, an object of this invention to provide a novel damping mechanism for improved truck squaring and reduced wear in a three piece railcar truck assembly.

Another object of the invention is to provide a damping mechanism capable of reducing wear of the friction elements of a truck assembly.

A further object of the invention is to bias the wedge of the damping mechanism of a truck assembly in a locked position in its retaining pocket.

Still another object of the invention is to reduce variable unit pressure between the frictional elements of a truck assembly at all positions.

These and other objects are attained in accordance with the invention wherein there is provided an improved damping mechanism for a truck assembly capable of overcoming the foregoing shortcomings while utilizing the same geometrical constraints of the standard three piece truck assemblies and the normal A.A.R. load springs currently being used.

In the preferred embodiment of the invention, bolster contacting wedges are spring loaded by resilient means resting on the side framing and urging the wedge upward. The wedge cooperates with the wedge pocket of the side frame to bias the wedge to the outside of the side frame. As a result, the wedge is held in position by four forces, namely the force between the wedge and back surface of the pocket, the wedge and a side surface of the pocket, the spring force and the force between the wedge and bolster wearplate. As a result, wear is reduced and effective energy dissipation is accomplished by the technique of the invention.

BRIEF DESCRIPTION OF THE DRAWINGS

Further objects of the invention, together with additional features contributing thereto and advantages accruing therefrom, will be apparent from the following description of preferred embodiments of the invention which are shown in the accompanying drawings with like reference numerals indicating corresponding parts throughout, wherein:

FIG. 3 is an enlarged fragmentary horizontal sectional view taken approximately along the line 3—3 of FIG. 1;

FIG. 4 is an enlarged detail elevational view of a wedge member which is a component of the damping mechanism of FIG. 3;

FIG. 5 is a top view of the wedge of FIG. 4 taken along line 5—5 of FIG. 4;

FIG. 6 is an opposite side view taken along line 6—6 of FIG. 5; and

FIG. 7 is an alternate embodiment of the snubbing arrangement shown in FIG. 1.

DESCRIPTION OF THE PREFERRED EMBODIMENTS

Referring now to FIGS. 1–6, there is illustrated a first embodiment of the damping mechanism of the invention which is designed for snubbing the relative movement of a pair of elements of a truck assembly of a railway car, namely a bolster with respect to its side frames, in any and all possible directions. The particular embodiment shown in FIGS. 1–6 provides for generally equal damping in each lateral direction while providing for an increased vertical damping of the bolter in its downward motion as opposed to its vertical damping capacity when the bolster is in upward motion. Although such damping has been partially provided in the past, the improvements over these known designs made possible by the invention of the application will become apparent from the following description.

Figure 1:
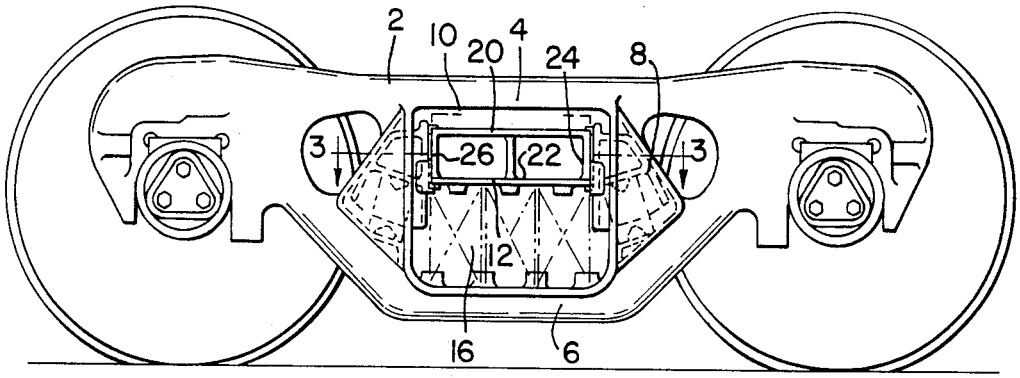
FIG. 1 is a side elevational view of a freight car truck assembly having a damping mechanism constructed in accordance with the present invention.

Referring to FIG. 1, there is illustrated the side frame member 2 of a railway car truck. Frame member 2 includes a compression member 4 and a tension member 6, respectively, interconnected by vertical columns 8. A bolster opening 10 is arranged to receive a bolster 12 between columns 8. The bolster is supported on a spring group 16 which rests on top of tension member 6.

Figure 2:
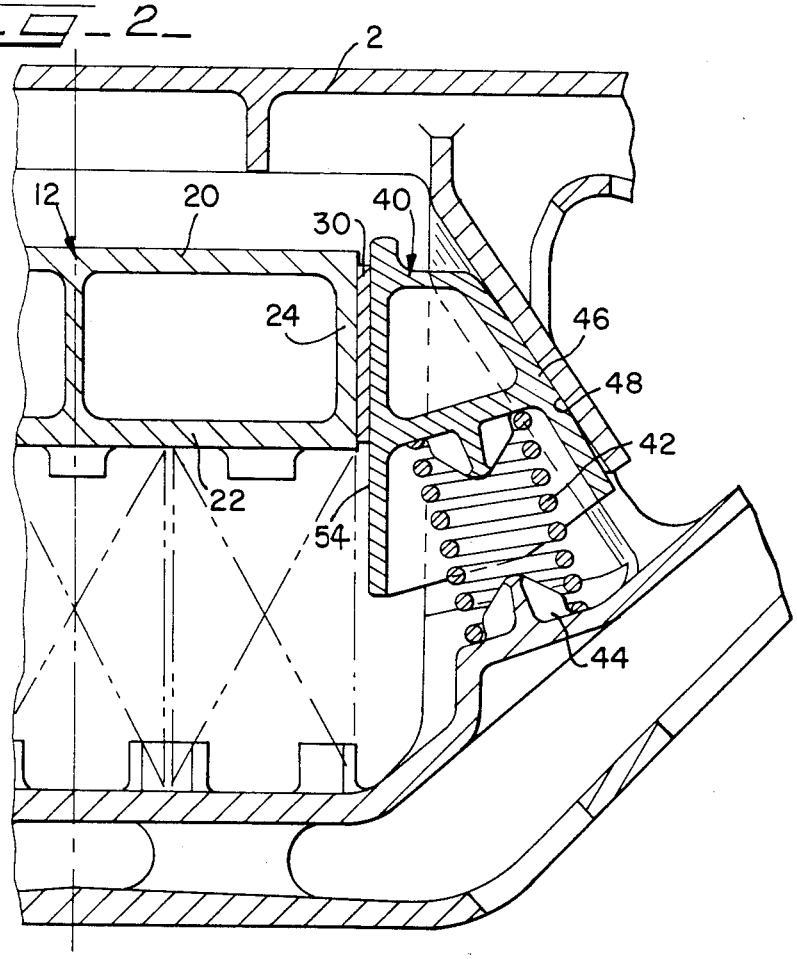
FIG. 2 is an enlarged fragmentary vertical sectional view illustrating the damping mechanism of the present invention.

The bolster 12 includes an upper wall 20 and a lower wall 22 along with a pair of side walls 24, 26, as seen in FIGS. 1 and 2. Hardened steel wear plates 30 are fixedly attached to the bolster 12 in suitable pockets provided between bolster gibs 32 and 34 (FIG. 3) and friction wedges 40 which are retained in biased pockets 40' within the side frame 2. As seen in FIG. 2, the wedge 40 is urged upwards and against the side walls of the side frame by means of a spring 42 suitable mounted on a spring seat 44. The wedge 40 includes a back surface 46 which is urged against the pocket surface 48 and a side surface 50 which is arranged to bear against an inner surface 52 of the side frame as illustrated in FIG. 2 and FIG. 3. A third surface 54 of the wedge bears against the wear plate 30 to dissipate energy during motion of the bolster. The wedges 40 are positioned on each side of the bolster 12 and generally have a hollow design forming the respective outer surfaces 46, 50, and 54 as most clearly shown in FIGS. 2–6.

The wall 48 of the wedge pocket is sloped toward the outside of the frame 2 and provides a biased surface to bias the wedge 40 to the outside. The wedge 40, thus, is held in its normal position by forces in four directions, namely, the spring force created by springs 42, the normal reaction between the surface 46 of the wedge and the surface 48 of the frame, the normal reaction between the wedge surface 50 and surface 52 of the frame, as best illustrated in FIG. 3, and, finally, the normal reaction between the surface 54 of wedge 40 and the outer surface of wear plate 30. As the bolster 12 goes up and down on the load springs 16, energy is dissipated by frictional contact between the surface 54 of the wedge 40 and the wear plate 30 on each side of the bolster.

As stated previously, the highest degree of wear in prior art trucks which is detrimental to service life is at the interface between the bolster inner gib 32 and the side frame column. In prior art trucks, the inner side frame column is extended close to the bolster between the gibs and lateral loads are reacted into the side frame column by the inner gibs. This is a place of rapid wear in common designs; but in the invention herein disclosed, the inner side frame column is relieved such that gib 32 reacts its lateral load into the wedge 40, thus eliminating contact between the inner side frame column and gib 32.

To prevent wear of the bolster inner gib 32, a flange 60 is provided on the wear plate 30 and substantially resolves the problem of wear.

Since the biased wedge 40 of the invention does not move laterally in the embodiments shown in FIGS. 1–6, wear is reduced on the back wall 48 of the side frame.

The damping mechanism of the invention permits wider wedges than previous designs, which when being urged into position with stronger than normal elastic means, increases damping and provides truck squaring moments not previously possible. This increase in the lateral wedge width and its retention also provides for increased damping in the lateral direction.

Referring to FIG. 7, there is illustrated another embodiment of the invention wherein the damping mechanism 60 includes wedges 62 resiliently urged and reversed in orientation placing the friction wedge into biased pockets within the bolster. The mechanism 60 reacts to the lateral loads through wedges 62 to shaped wear plates which are housed in suitable pockets in the side frame columns.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. In a freight car truck assembly, the improvement comprising, in combination, a pair of spaced side frames supported on wheel assemblies, a bolster opening in each side frame, a bolster having its opposite ends received in respective side frame bolster openings, bolster spring means in each side frame supporting opposite ends of said bolster, each of said side frames having a pair of wedge pockets formed therein on opposite sides of the adjacent bolster end, a pair of friction damping wedges mounted in respective ones of said pockets in each of said side frames, first biasing means biasing said wedges upwardly in said pockets into engagement with opposite sides of said adjacent bolster end, and second biasing means biasing each of said wedges in its pocket toward the outside of the corresponding side frame.

2. In a freight car truck assembly as defined in claim 1 where said first biasing means comprises a compression spring.

3. In a freight car truck assembly as defined in claim 1 where each wedge pocket has a back wall which is inclined away from the adjacent bolster end as said wall extends toward the outside of said side frame, said first biasing means urging its corresponding wedge against said inclined back wall and said inclined back wall biasing said wedge in its pocket toward the outside of the corresponding side frame.

4. In a freight car truck assembly as defined in claim 1 where said bolster includes projecting gib means on opposite sides of each bolster end, said gib means each being positioned immediately inside of a corresponding one of said wedges whereby a lateral load on said bolster directed to the outside of one of said side frames will be transferred from said bolster through said gib means to the pair of wedges in said one side frame whereby said wedges will transfer said load to said side frame.

5. In a freight car truck assembly as defined in claim 4 where a wear plate is mounted on each of said gib means on the outside facing the corresponding wedge.

6. In a freight car truck assembly, the improvement comprising, in combination, a pair of spaced side frames supported on wheel assemblies, a bolster opening in each side frame, a bolster having its opposite ends received in respective side frame openings, bolster spring means in each side frame supporting said opposite ends of said bolster, each of said frames having a pair of wedge pockets formed therein on opposite sides of the adjacent bolster end, said pockets each having a back wall inclined to make the pocket narrower at its upper end, said back wall also being inclined away from the adjacent bolster end as said wall extends toward the outside of said side frame, a pair of friction damping wedges mounted in respective ones of said pockets in each of said side frames, wedge spring means biasing said wedges upwardly in said pockets into engagement with opposite sides of said adjacent bolster end and also into engagement with said back wall, said inclined back wall biasing said wedge in its pocket toward the outside of the corresponding side frame.

7. In a freight car truck assembly as defined in claim 6 where said bolster includes projecting gib means on opposite sides of each bolster end, said gib means each being positioned immediately inside of a corresponding one of said wedges whereby a lateral load on said bolster directed to the outside of one of said side frames will be transferred from said bolster through said gib means to the pair of wedges in said one side frame whereby said wedges will transfer said load to said side frame.

8. In a freight car truck assembly as defined in claim 7 where a wear plate is mounted on each of said gib means on the outside facing the corresponding wedge.

* * * * *